US005803459A

United States Patent [19]

Casas-Salat

[11] Patent Number: 5,803,459

[45] Date of Patent: Sep. 8, 1998

[54] COUNTER FOR PARLOUR GAMES

[75] Inventor: Joaquin Gracia Casas-Salat, Barcelona, Spain

[73] Assignee: Grupo Promer Mon-Graphics, S.A., Spain

[21] Appl. No.: 853,759

[22] Filed: May 9, 1997

[30] Foreign Application Priority Data

May 30, 1996 [ES] Spain ..... 9601481

[51] Int. Cl.[6] ..... A63F 3/00

[52] U.S. Cl. ..... 273/288; 273/108.5; 273/126 R; 273/108; 473/588

[58] Field of Search ..... 473/54, 131, 416, 473/569, 587, 588, 589, 591; 273/108, 108.1, 108.2, 108.4, 108.5, 126 R, 288, 289, 290

[56] References Cited

U.S. PATENT DOCUMENTS

| | | | |
|---|---|---|---|
| 2,600,856 | 6/1952 | Decepoli | 473/588 |
| 2,695,174 | 11/1954 | Cusano | 473/588 |
| 4,176,843 | 12/1979 | DeWitt | 473/588 |
| 4,637,613 | 1/1987 | Bishop | 273/289 |
| 5,676,376 | 10/1997 | Valley | 473/588 |

*Primary Examiner*—William M. Pierce
*Attorney, Agent, or Firm*—Ostrolenk, Faber, Gerb & Soffen, LLP

[57] ABSTRACT

A combination for a parlour game includes two circular pieces of different colors, one of which has an open cavity in its main face, the other of which has a detachable portion adapted to fit into the open cavity. The combination can also include a launching tool.

7 Claims, 2 Drawing Sheets

COUNTER FOR PARLOUR GAMES

This invention relates to a new counter for parlour games.

More particularly, the invention provides a new counter which may be used to play a plurality of children's games, known generically as "parlour games" because they involve several playmates, making the playing of them very positive from the point of view of the child's education, owing to the relationship established between the participants.

A preferred use of the counter constituting the subject matter of the present invention is for playing tabletop football or derivatives thereof, such as five-a-side football or seven-a-side football, or other games such as, inter alia, skittles, boules, basketball etc.

According to the invention there is provided a counter for parlour games, essentially comprising two circular pieces of different colours and preferably of equal radius, one of which comprises an open cavity in its main face of such size that it can firmly accommodate a detachable portion of the other of the piece, which portion remains visible when the two pieces are attached, the two components forcing a counter assembly in a combination of colours. The special structure, design and colours of the counter are obtained from the two pieces of moulded plastics material, which are circular in form, each of one colour.

The said one piece which can be considered as the main or basic piece has a recessed cavity shaped and dimensioned to accommodate under pressure, by resilient yielding of the material, a detachable portion of the other piece. The two components then form a counter assembly of two colours selected by the child himself.

In accordance with the above, the child constructs its counters from a plurality of pieces of the two above-mentioned types and of various colours. Likewise, the child selects the colours to form the desired combinations, according to his favourite teams, eg. football teams.

Other auxiliary elements conventional in type; such as a counter launcher, goals and balls complete the game.

One aim of the invention is to supply the component pieces of the counter in a conventional case, in which are also included the auxiliary elements, launcher, goals, balls, rules etc.

Another aim of the invention is to supply the component pieces of the counter in unitary form, as promotional articles with food products generally consumed by children.

BRIEF DESCRIPTION OF THE DRAWINGS

The invention will now be described, by way of example, with reference to he accompanying drawings, in which.

DETAILED DESCRIPTION OF THE DRAWINGS

Figure 1:
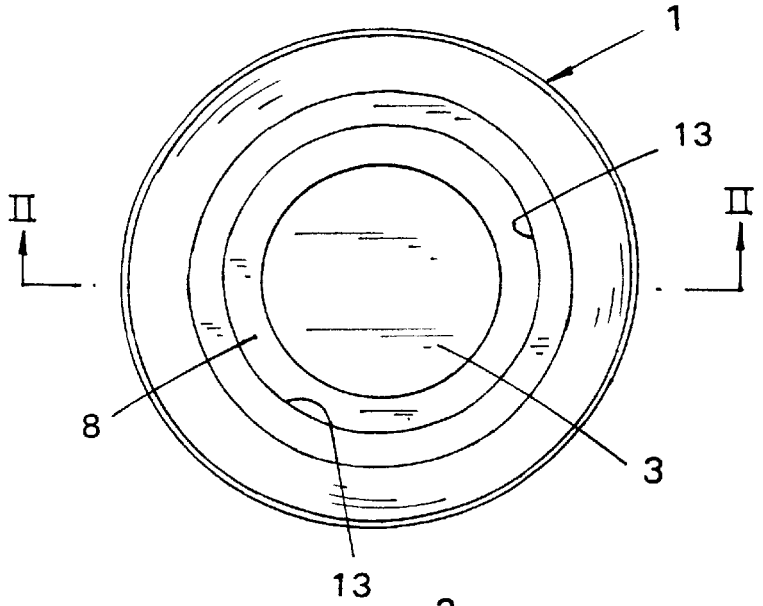
FIG. 1 shows the main or basic component of the counter, in plan view from above.
Figure 2:
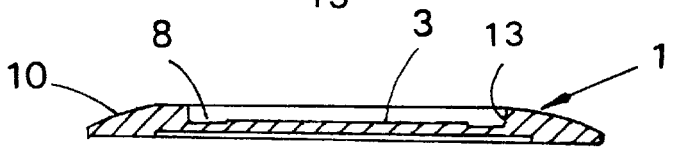
FIG. 2 is a diametrical section of the basic piece taken on the line II—II of FIG. 1.
Figure 3:
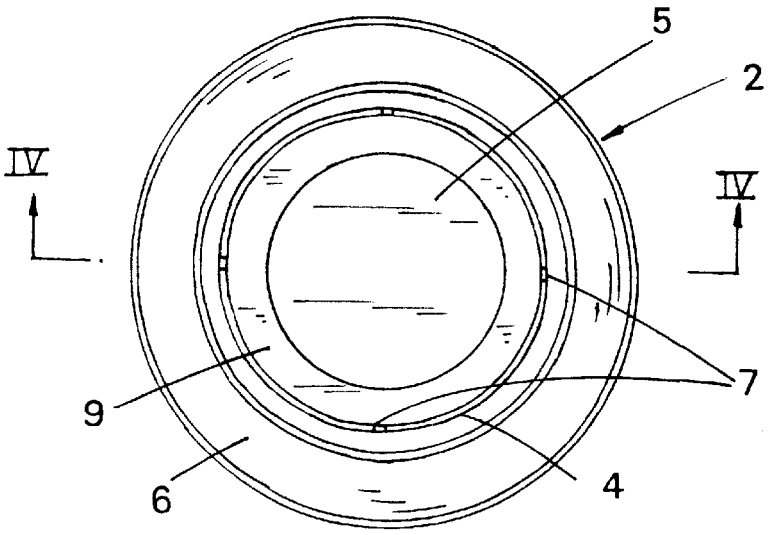
FIG. 3 shows the other component piece of the counter in plan view.
Figure 4:
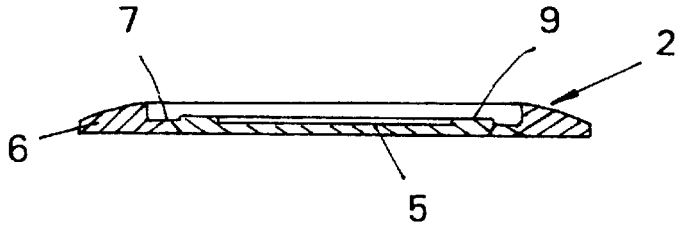
FIG. 4 is a diametrical section taken on the line IV—IV of FIG. 3.
Figure 5:
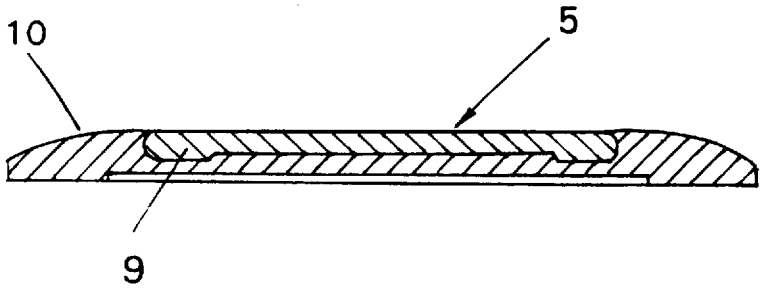
FIG. 5 is a diametrical section of the counter obtained by means of the firm connection of the pieces illustrated in the previous Figures.

The Figures show an embodiment of a new counter for parlour games, made of two pieces 1 and 2, both circular in form.

The preferred measurements of the pieces, without being limiting in any way, are 34 mm in diameter for the pieces 1 and 2 and 2.5 mm in height.

The piece 1 is circular and has an upper bevelled edge 10. It has a circular central recess 3 which is preferably 0.7 mm deep, 20 mm in diameter at its mouth 13 and 20.4 mm in diameter at its internal maximum.

The piece 2 comprises an outer ring 6 separated by an annular groove 4 from an inner detachable portion 5. The inner portion 5 is connected with the outer ring 6 by means of points 7 weakened for easy breaking. The diameter of this portion 5 is preferably 20.3 mm.

The recess 3 is shaped so that it has an outer peripheral annular depression 8. The portion 5 has a corresponding annular projection 9.

For use a child can construct the counter using one piece 1 and one piece 2. He selects the colours to form the desired combination.

The child detaches the portion 5 from the piece 2, and can use the remnant ring 6 for other games. The portion 5 is then inserted into the cavity 3 in the piece 1 where it is a snap fit as a result of the resilient yielding of the material this brings about a firm connection of the two parts. The resulting counter will exhibit the combination of colours chosen previously and will form a unit for the games to be played.

Figure 6:
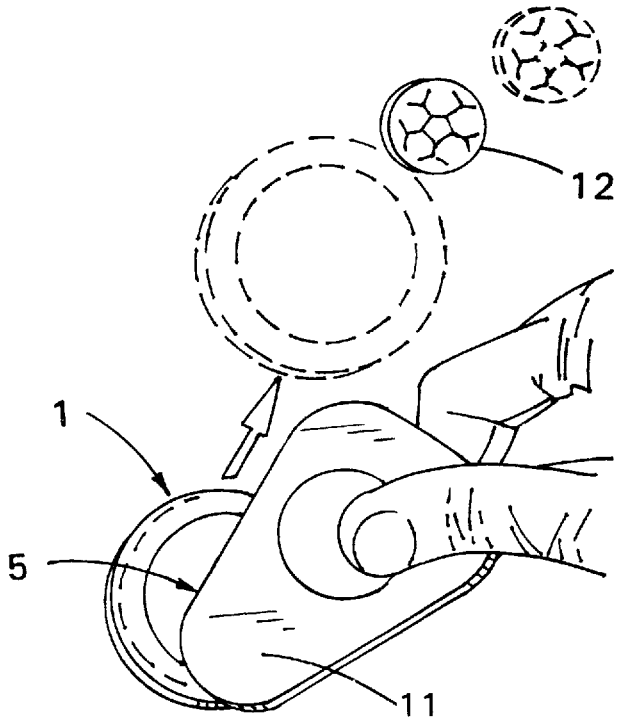
FIG. 6 shows the counter and a tool for launching the counter towards the ball.

The bevelled edge 10 of the piece 1 permits displacement of the counter over a smooth surface, with the aid of a launching tool 11 formed of a flat member with an indentation for the thumb, as illustrated in FIG. 6 of the drawings. The counter can be propelled to strike another counter 12, eg. of smaller radius, acting as a ball, which is sent on its intended trajectory.

The piece 5 may also have an adhesive layer to which can be adhered an impression, for instance of the face or crest of a sports club player, or a printed sheet.

I claim:

1. A combination for parlour games comprising a first flat circular piece of a first color having a main face opposing an open cavity surface with a base surface in its main face and a second circular piece of a second color comprising inner and outer annular members discontinuously joined by breakable material, the inner member having a shape complimentary to the open cavity of the first piece and adapted to snap fit in the open cavity of the first piece.

2. The combination of claim 1 wherein the inner and outer annular members of the second piece are separated by a groove which comprises the breakable material.

3. The counter of claim 2 in which the open cavity is circular and concentric with the first piece and in which a diameter of the cavity in a plane of said main face is less than a maximum diameter of the cavity.

4. The combination of claim 3 in which the base surface of the open cavity has an annular depression therein.

5. The combination of claim 4 wherein the first and second pieces have equal radii.

6. The combination of claim 5 further comprising a substantially flat member which is trapezoidal in form with rounded points adapted to propel at least one of said first and second pieces over a surface for the purpose of striking another of said at least one first and second pieces, said substantially flat member having a circular indentation to support the finger of a player at its widest part.

7. The combination of claim 1 further comprising a substantially flat member which is trapezoidal in form with rounded points adapted to propel at least one of said first and second pieces over a surface for the purpose of striking another of said at least one first and second pieces, said substantially flat member having a circular indentation to support the finger of a player at its widest part.

* * * * *